US006089946A

United States Patent [19]

Yang

[11] Patent Number: 6,089,946

[45] Date of Patent: Jul. 18, 2000

[54] TOP LAUNCHER WITH POSITIVE TOP ENGAGEMENT

[76] Inventor: Chin-Long Yang, No. 48, Lane 502, Wen-Shyan Rd., Tainan, Taiwan

[21] Appl. No.: 09/252,687

[22] Filed: Feb. 22, 1999

[51] Int. Cl.[7] ..... A23H 1/06; A23H 1/18

[52] U.S. Cl. ..... 446/259; 446/257

[58] Field of Search ..... 446/223, 256, 446/257, 259, 262, 263, 264

[56] References Cited

U.S. PATENT DOCUMENTS

| | | | |
|---|---|---|---|
| 1,858,639 | 5/1932 | Oram | 446/257 X |
| 2,839,869 | 6/1958 | Lopez | 446/257 X |
| 3,082,574 | 3/1963 | Hellman | 446/259 |
| 3,224,142 | 12/1965 | Pawelka et al. | 446/259 X |
| 3,254,446 | 6/1966 | Endris | 446/259 X |
| 3,365,835 | 1/1968 | Grow | 446/233 |
| 3,623,262 | 11/1971 | Noda | 446/259 X |
| 4,932,918 | 6/1990 | Onoda | 446/256 X |
| 5,024,625 | 6/1991 | MacCarthy | 446/259 |
| 5,683,284 | 11/1997 | Christen | 446/266 |

FOREIGN PATENT DOCUMENTS

| | | | |
|---|---|---|---|
| 8197 | 6/1909 | United Kingdom | 446/257 |
| 656951 | 9/1951 | United Kingdom | 446/233 |

*Primary Examiner*—D. Neal Muir
*Attorney, Agent, or Firm*—Rosenberg, Klein & Lee

[57] ABSTRACT

A spinning top includes a driving device and a series of tops. The driving device includes a motor driving a clutch, and each top has a seat for temporary engagement with the clutch which drives the top to spin. The driving device comprises a control switch which links the power to the motor and the linking mechanisms to the clutch. By adjusting the control switch, the motor is started, which drives the clutch to spin. Pressing the control switch further disengages the top from the clutch so that the top will spin itself. Further, the top portion of the top is shaped with a concave portion for receiving another top stacked thereon, by engaging the concave portion with the seat of another top.

3 Claims, 9 Drawing Sheets

TOP LAUNCHER WITH POSITIVE TOP ENGAGEMENT

BACKGROUND OF THE INVENTION

1. Field of the Invention

This invention relates to a spinning top and more particularly to a pistol shaped device which produces a spinning force to spin tops.

2. Prior Art

A top is one of the most favorite toys for young children to play with. However, in this high technology era, most toys today are equipped with sound and lights, which are more attractive to children than traditional toys. Nevertheless, the spinning effect of a top still has a special attraction to children.

A prior art top and launcher, as show in FIG. 8, has a motor 61 secured in a driving device 6 with a spindle 611 extending upwardly for the top 7 to be seated thereon and to be released therefrom. The driving device 6 has a rod 62 extending upwardly from one end of the upper cover, and a push rod 63 which has an end connected to the end of the rod 62, while the other end of the push rod 63 has a sloped surface 631 having a fork portion straddling the motor spindle 611. Thus, the top 7, is shown in FIG. 9, has its rotating stem 71 extending from the bottom of the top 7 and inserted into the motor spindle 611 to be driven by the motor 7 to spin. When the spinning force of the top 7 has reached to a preset speed, by pulling the rod 62 rearward which links the slope surface 631 to extend forward, the slope surface 631 will push the spindle 611 and the stem 71 of the top 7 to separate from the driving device 6.

However, the stem 71 of the top 7 is ejected by the driving device 6 to land on the ground through the pushing force, which can not control when and where the top 7 lands, and both of the user's hands are required to operate the top 7 and the driving device 6 to eject the top 7, which is inconvenient. Further, the stem 71 of the top 7 is a hollow design, in order to be sleeved onto the spindle 611, therefore the end point is not in a cone shape, and it can not spin steadily. The hollow inner diameter will deteriorate through use, after a period of time. Moreover, the design of the prior art device can only handle one top 7 at a time, which is not attractive at all.

SUMMARY OF THE INVENTION

It is the primary object of the present invention to provide a spinning top which can control more than one top at one time.

It is another object of the present invention to provide a spinning top which is easy to operate and more stable.

It is a further object of the present invention to provide a spinning top which is inexpensive to manufacture.

DETAILED DESCRIPTION OF THE PREFERRED EMBODIMENT

Figure 1:
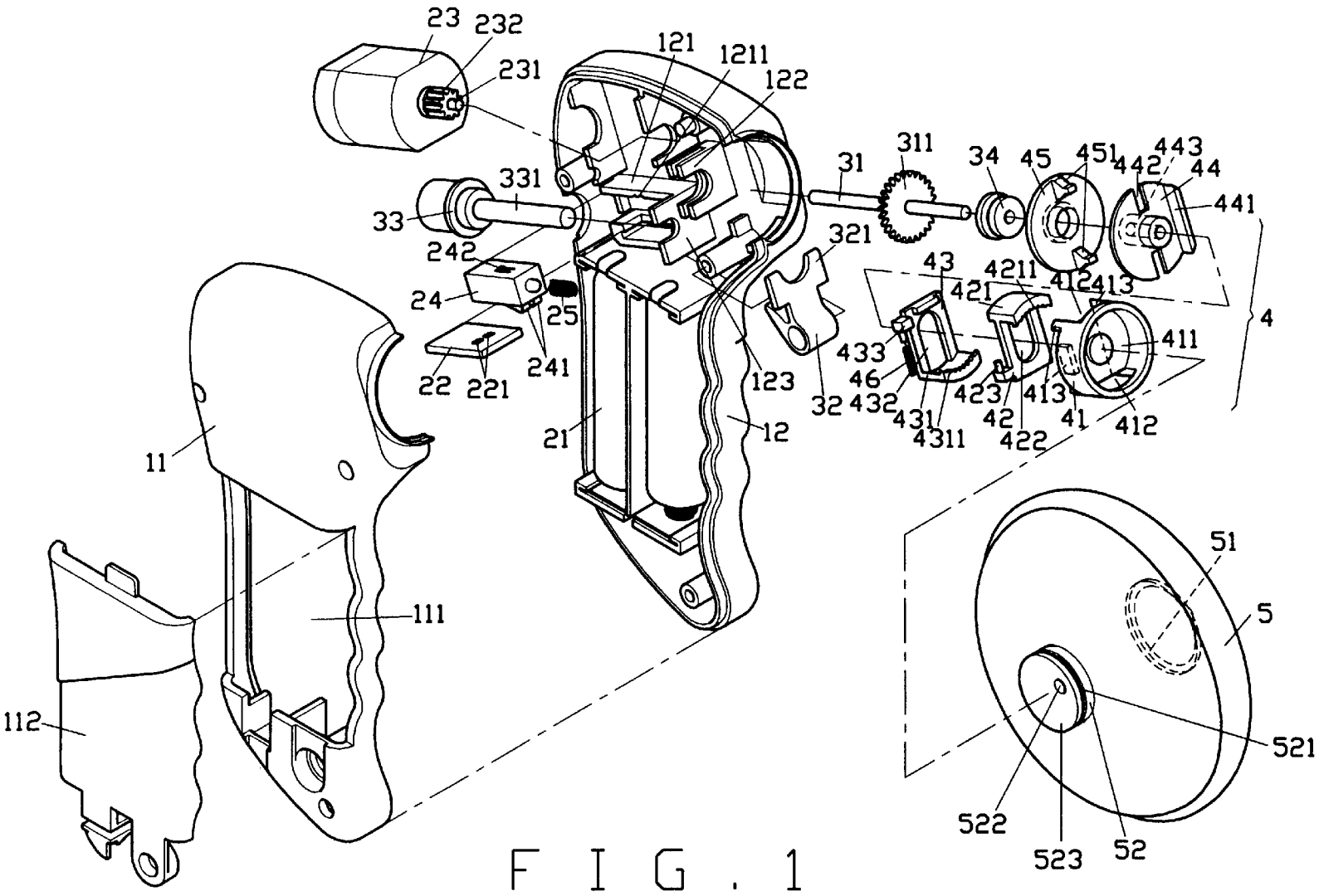
FIG. 1 is an exploded view of the present invention.
Figure 2:
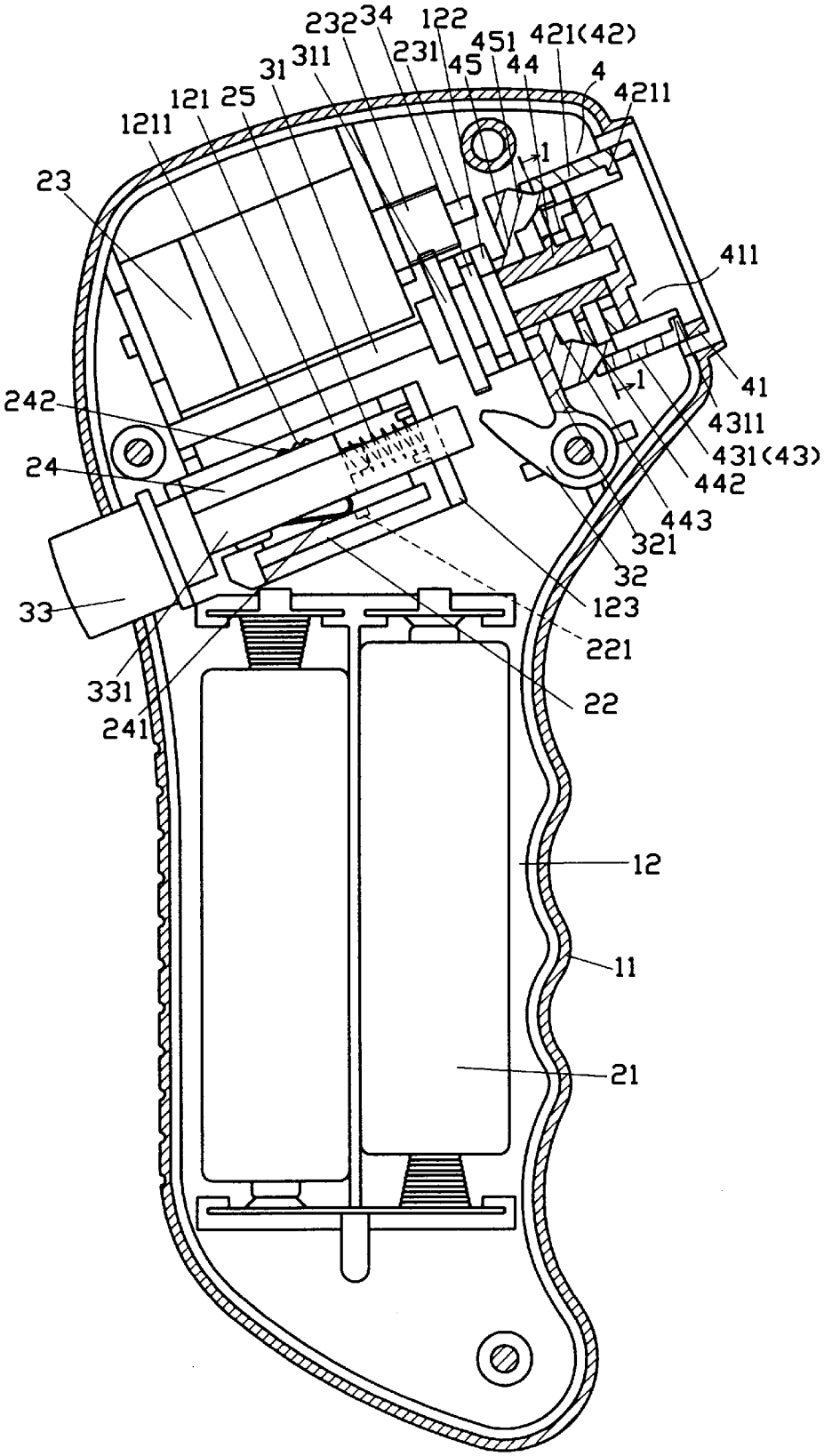
FIG. 2 is a side elevation view of the present invention, partially sectioned.

The spinning top of the present invention generally comprises a driving device and tops, as shown in FIGS. 1 and 2.

Figure 3:
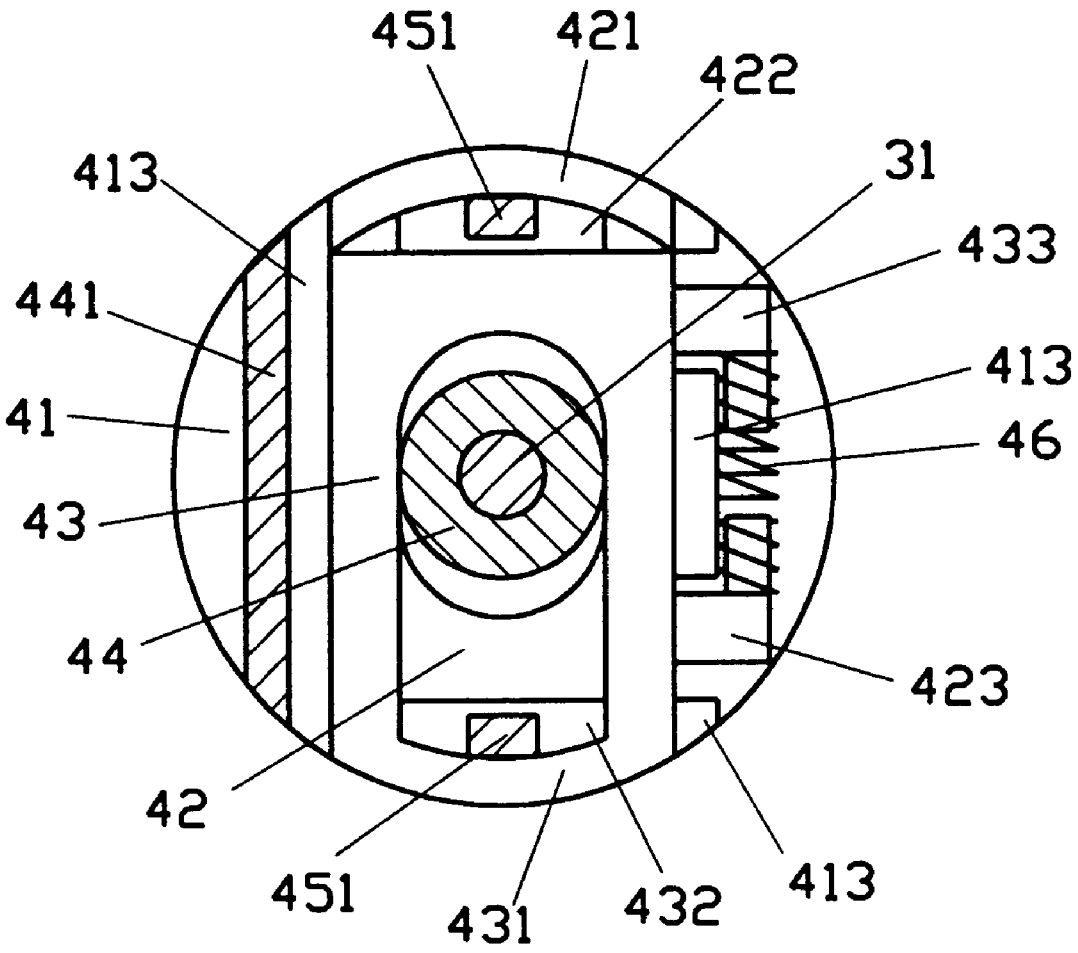
FIG. 3 is a cross section view taken along line 1—1 of FIG. 2.

The driving device is encompassed in a body which includes an upper and lower shells 11 and 12, which driving device has a battery compartment 21, a conducting plate 22, a motor 23, a conducting block 24 and a control switch 33. The battery compartment 21 is electrically connected to one contact point of the conducting plate 22 and the motor 23, respectively. The conducting plate 22 also has a connection to the motor 23 extended from a contact point. The conducting block 24 is positioned against the conducting plate 22, and the bottom seats on a sliding frame 121 within the lower shell 12 and is upwardly urged by a spring 25. The conducting block 24 has two conducting pieces 241 corresponding to two contact points 221 of the conducting plate 22. The top of the conducting block 24 is formed with a protuberance 242 and the sliding frame 121 is formed with recesses 1211, corresponding to the protuberance 242. The spindle 231 of the motor 23 has a gear 232 meshing with the gear 311 of the transmitting shaft 31, the transmitting shaft 31 is inserted through a sleeve 34 and secured in the support 122 of the lower shell 12. The clutch 4 has a round base 41 having a pair of left and right clamps 42 and 43 corresponding to each other, and a pushing plate 45. The transmitting shaft 31 is inserted through the support plate 44 connected to the pushing plate 45, and secured at the round base 41, with the left and right clamps 42 and 43 being positioned between the support plate 44 and the round base 41 in a sliding manner. The round base 41, as shown in FIG. 3, has a round recess 411 at a front side position, and two recesses 412 at the bottom, corresponding to each other. The recesses 412 are adapted to respectively receive a pair of arc plates 421 and 431 of the clamps 42 and 43 therein. The round base 41 further has a plurality of limitators 413 surrounding the clamps 42 and 43, for limiting movement. Each of the right and the left clamps 42 and 43 has a respective opening 422 and 432, for passage of the transmitting shaft 31 therethrough, and each has a respective protuberance 423 and 433 for a spring 46 to be sleeved thereon, which constantly urges the arc plates 421 and 431 towards the center. The inner end of the top portion of the arc plates 421 and 431 are respectively formed with gears 4211 and 4311. On the back of the support plate 44 there is a block 441 that contacts the limitator 413. The support plate 44 has a pair of notches 442 on the rim and a shaft 443 extending from the center of one side of the support plate 44 for sleeving the pushing plate 45 thereon. The pushing plate 45 has a pair of slope plates 451 corresponding to the two notches 442 of the support 44 that engage with the bottom portions of the openings 422 and 432 of the left and right clamps 42 and 43. By pushing the clamps 42 and 43, the slope plates 451 displace clamps 42 and 43 outward. The knob 32 is positioned near the pushing plate 45, one end of the knob 32 having a spring plate 321 extending therefrom and engaged with the back of the pushing plate 45. The control switch 33 seats on the sliding block 24 and is linked thereto. The switch 33 has a shaft 331 extending from an inner end thereof and through a locator 123 and corresponding to the knob 32, so as to push the knob 32 to swing the spring plate 321 and to press the pushing plate 45. The upper shell 11 has an opening 111 covered by a battery compartment cover 112.

The top 5 has a cone-shaped shaft 51 at the bottom center portion thereof, and a seat 52 at the top center portion of top 5. The seat 52 is surrounded with a ring of teeth 521, and has a hole 522 formed in a concave portion 523.

Figure 4:
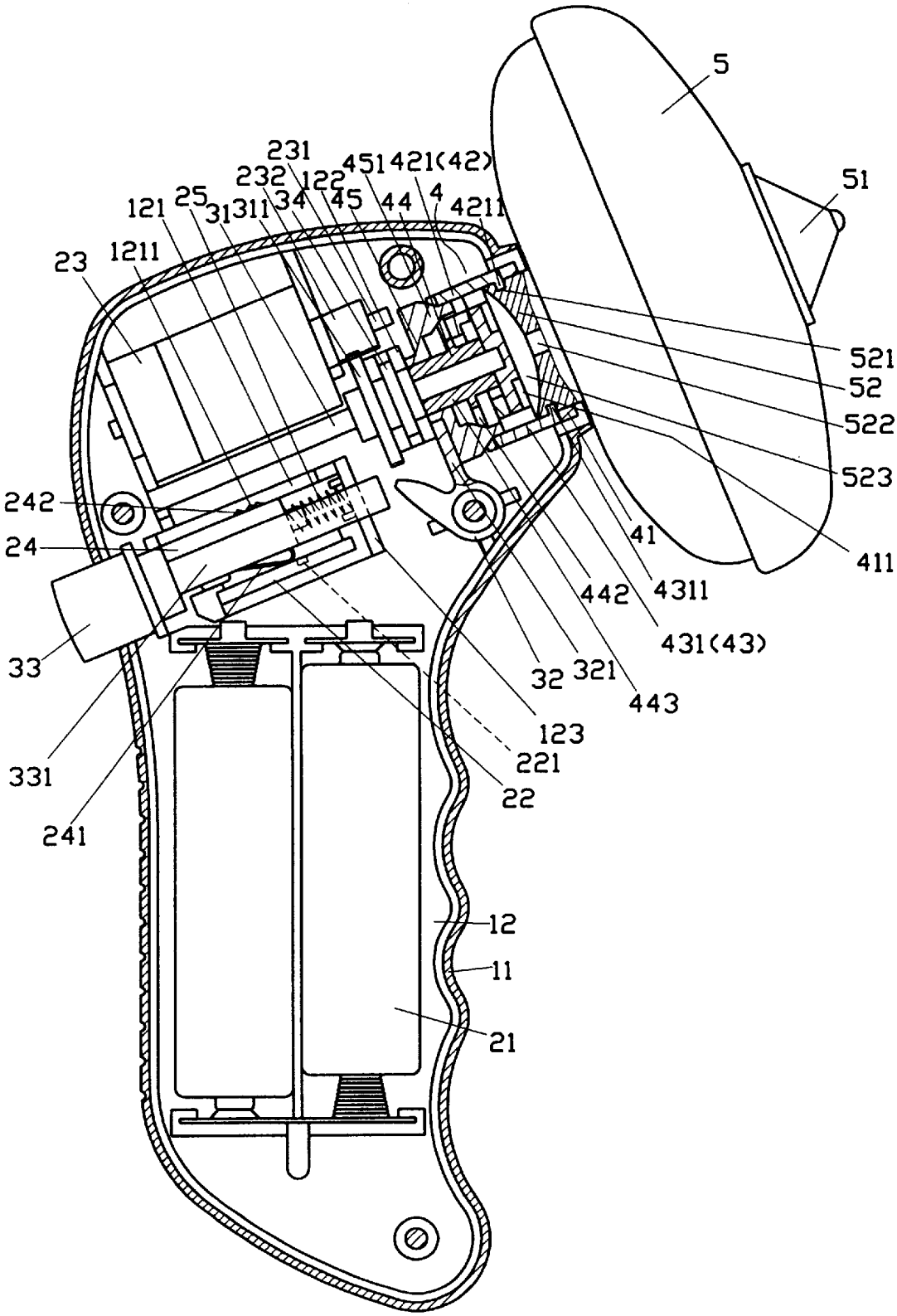
FIG. 4 is a perspective view of the present invention showing a top being mounted on the driving shaft.
Figure 5:
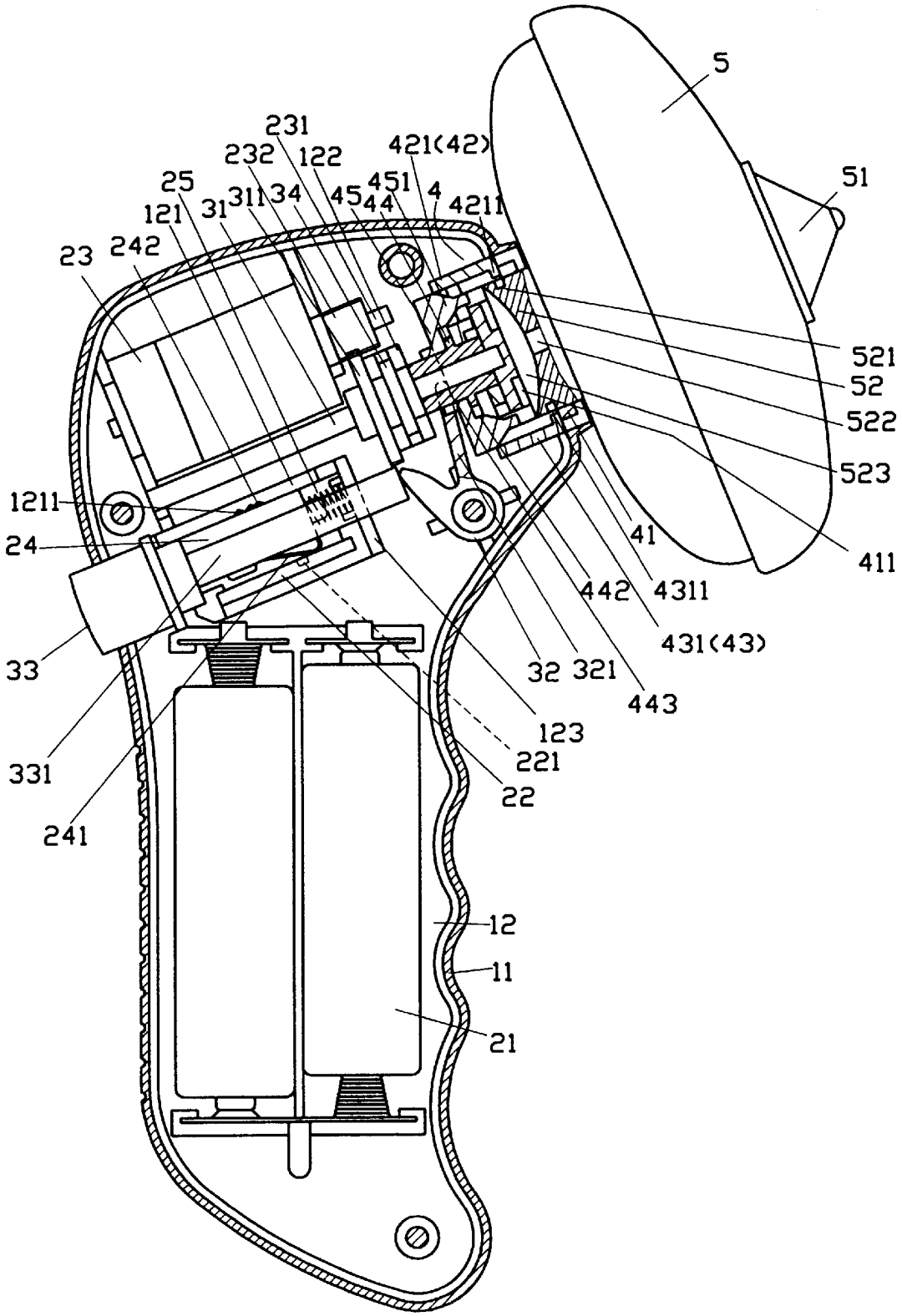
FIG. 5 is a view similar to FIG. 4, with the top being ready to be released.
Figure 6:
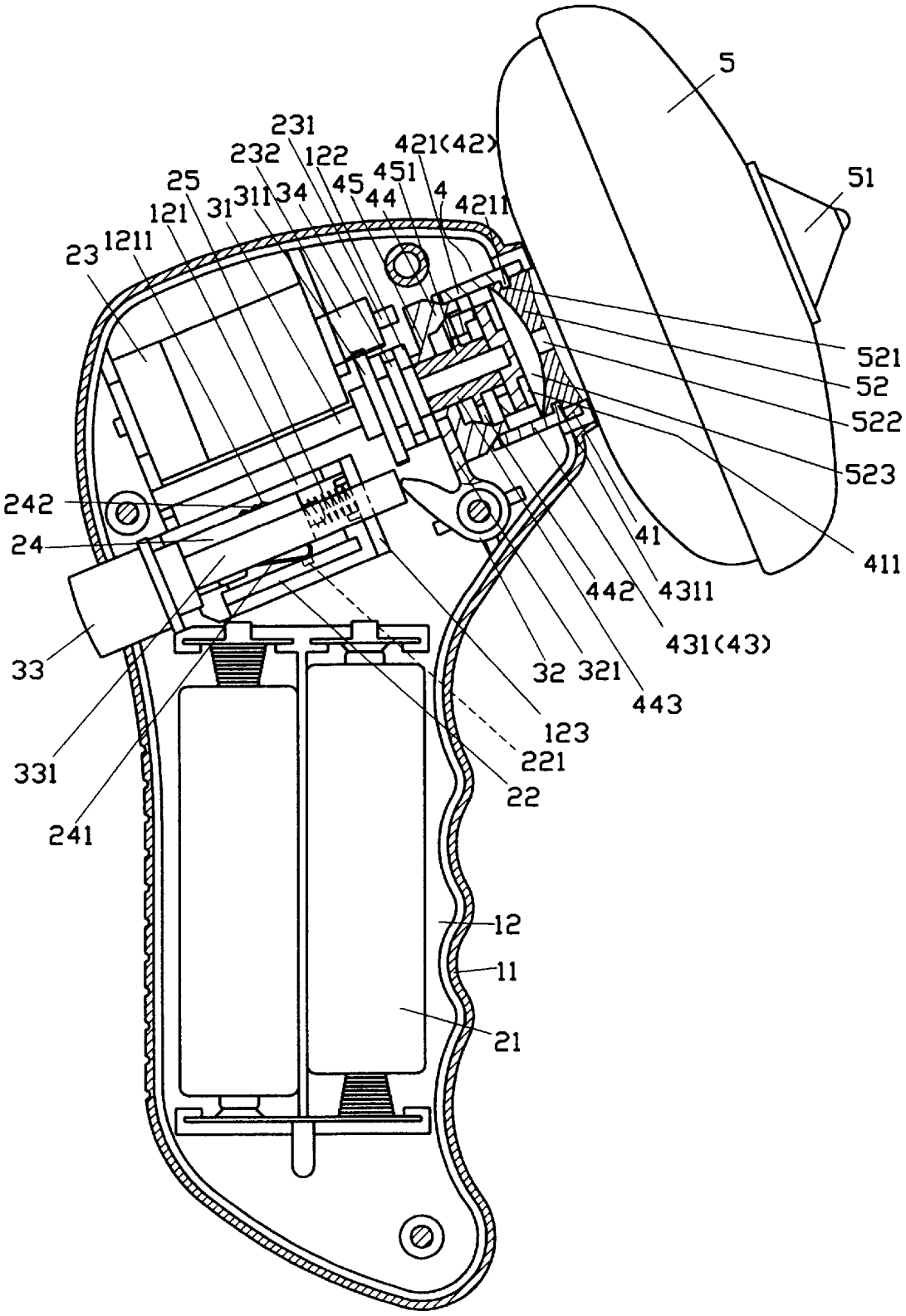
FIG. 6 is a view showing the top being released from the driving shaft.

To operate the device, as shown in FIG. 4, the seat 52 of the top is aligned and pushed into the recess 411 of the round base 41 of the clutch 4. The left and the right clamps 42 and 43 are first pushed to spread and then urged by the spring 46 to close, with their gears 4211 and 4311 engaging the ring of teeth 521 of the seat 52. When the control switch 33 is pressed, the conducting seat 24 is linked to move simultaneously, as shown in FIG. 5, and the protuberance 242 will be extended into the recess 1211 of the sliding frame 121. (Note: the urging force from the spring 25 is still larger than the engaging force between of the protuberance 242 and the recesses 1211). The conducting plate 241 of the sliding seat 24 is in contact with the two contact points 21 to conduct electric power which drives the spindle 231, and thereby the gear 232 of the motor 23, to spin, which then drives the gear 311 of the transmitting shaft 31 to rotate the clutch 4 and the top 5. Upon the spinning speed reaching a certain limit, the further pressing of the control switch 33 may be processed, as shown in FIG. 6, which moves the sliding seat 24 forward and the protuberance 242 reaches the third of the recesses 1211. At that position, the conducting plate 241 disengages from the two contact points 221 and the motor 23 is stopped. Meanwhile, the shaft 331 at the inner end of the control switch 33 pushes the knob 32 to swing, with the spring plate 321 pressing the pushing plate 45 towards the direction of the left and the right clamps 41 and 43. The slope plate 451 will pass into the notch 442 of the support plate 44 and press the bottom portions of the arc plates 421 and 431 of the left and right clamps 42 and 43, respectively, which urges the spring 46 to expand. Thus, the left and the right clamps 42 and 43 expand outwardly, and the top 5 is released from the driving device.

Figure 7:
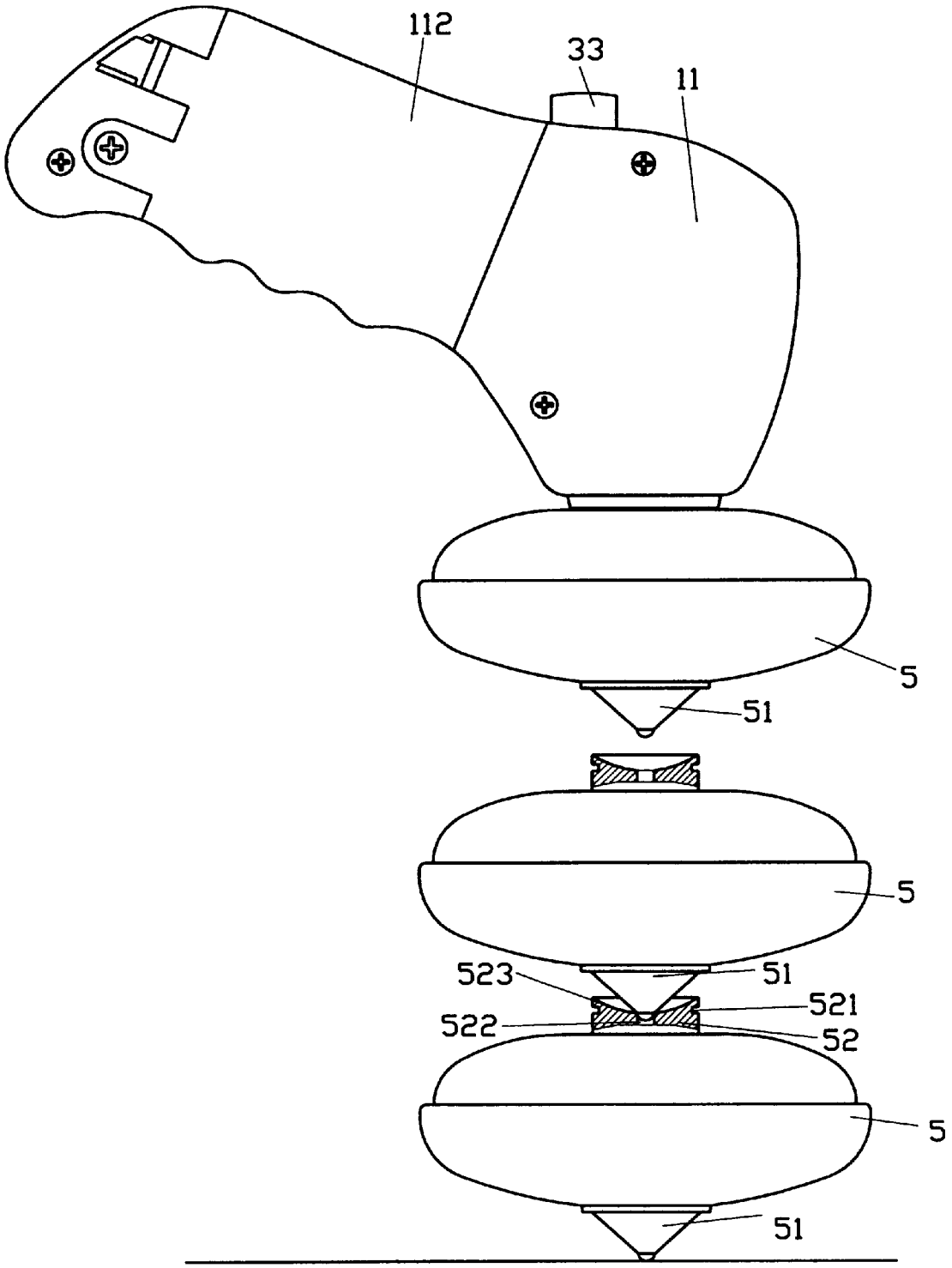
FIG. 7 is a view showing how to stack tops on each other.
Figure 8:
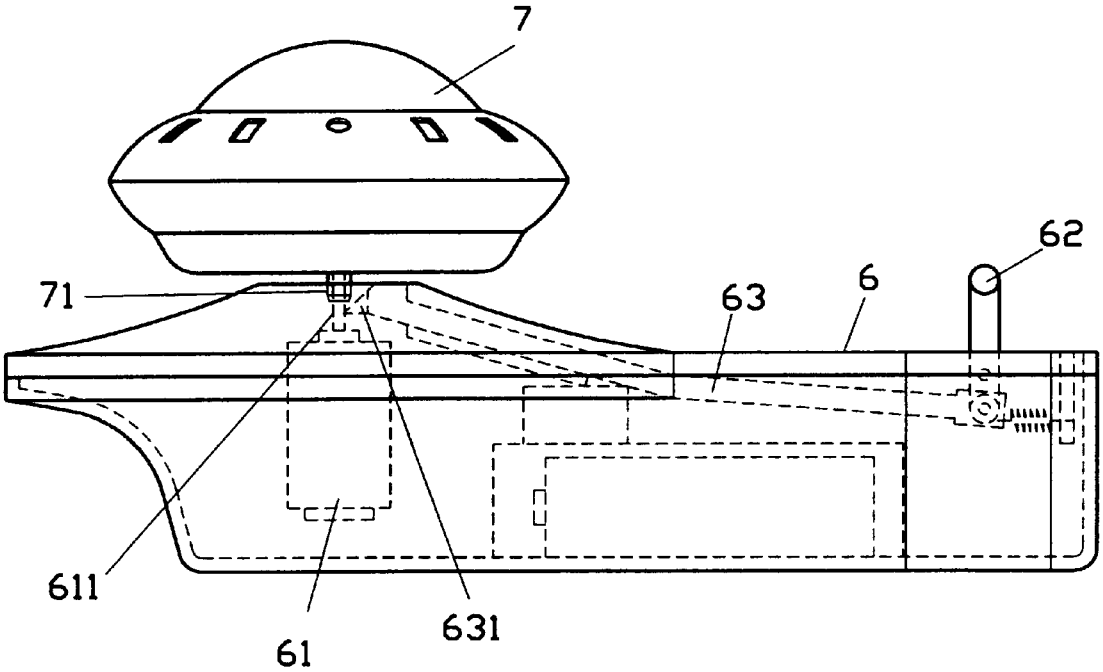
FIG. 8 (PRIOR ART)
FIG. 8 is a prior art device showing a top being stacked on the driving shaft.
Figure 9:
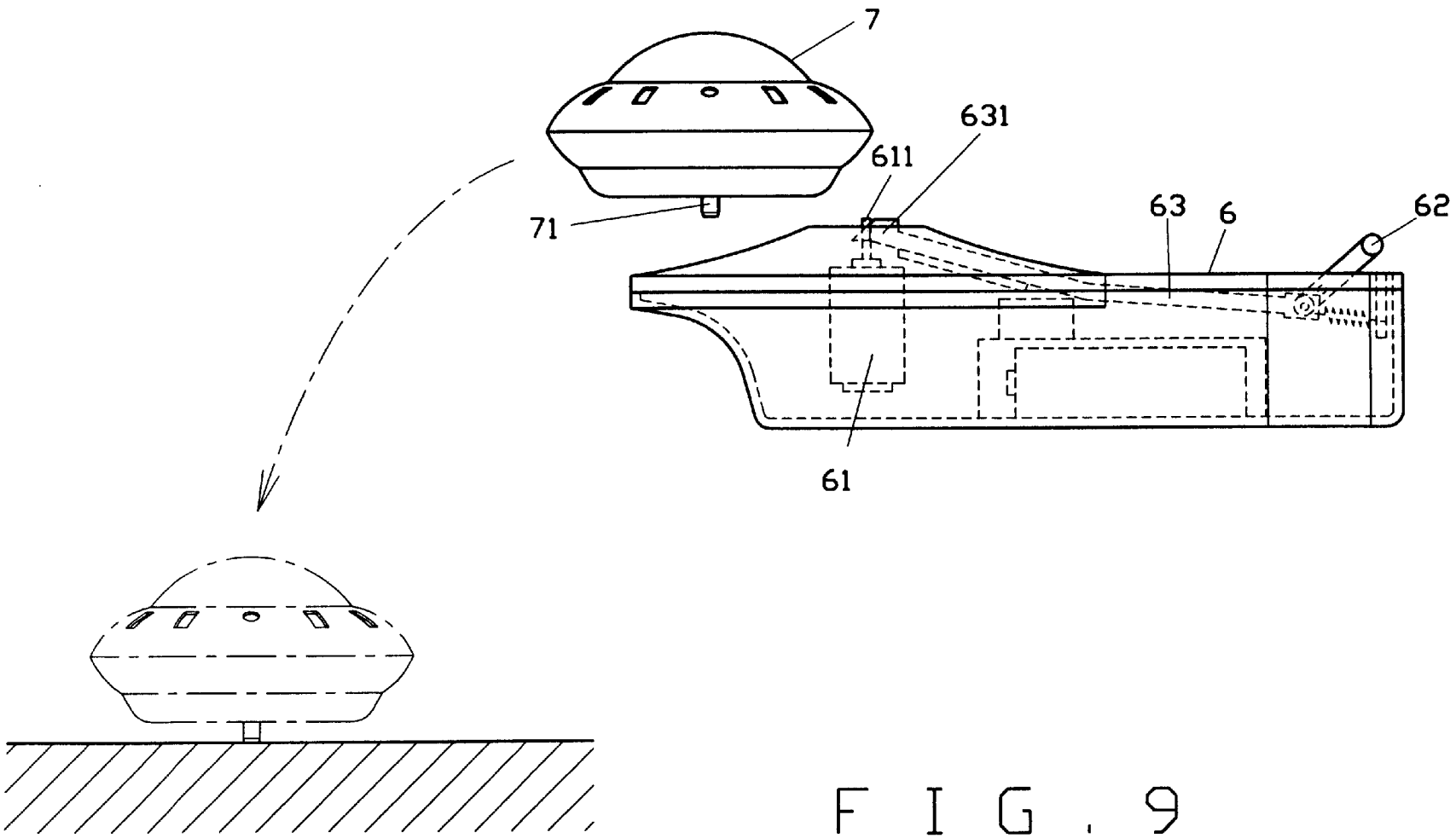
FIG. 9 (PRIOR ART)
FIG. 9 is a view of the prior art device showing the top being released.

The top 5, by using the hole 522 of the concave portion 523 of the seat 52, is able to stack with another top and together, simultaneously spin, as shown in FIG. 7, by the bottom cone shaft portion 51 of one top 5, engaging the other top 5. One by one tops 5 are likewise stacked together.

What is claimed is:

1. A spinning top comprising a driving device and a top, said driving device comprising an upper shell and a lower shall, and comprising a battery compartment, a conducting block, a motor, a transmitting shaft, a clutch, a knob, a sliding frame and a control switch, said conducting block being mounted in a bottom portion of said lower shell within a sliding frame and urged by a spring;

said motor having a spindle with a gear meshing with a gear of said transmitting shaft, said transmitting shaft passing through said clutch;

said clutch having a round base with a left clamp and a right clamp on a back side of said round base, and a pushing plate, said transmitting shaft passing through said pushing plate, a support plate, and said round base, said left clamp and said right clamp each having an arc plate with gear teeth formed therein, said round base having a round recess and a pair of recesses corresponding to each other for said arc plates to respectively seat therein, said round base having limitators on the back side thereof for limiting displacement of said left clamp and said right clamp, said left clamp and said right clamp each having a hole at a center portion for said transmitting shaft to pass therethrough, a protuberance extends from one end of each of said clamps with a spring sleeved therebetween, said support plate having two notches formed therein, said pushing plate including a pair of slope plates respectively aligned with said two notches for urging said left clamp and said right clamp outwardly responsive to displacement of said pushing plate, said knob having one end extending against a back side of said pushing plate;

said control switch being mounted on said conducting block and having one inner end connected to said knob for displacing said knob and thereby displacing said pushing plate;

said top having a seat at a top end with a ring of teeth releasably engaged by said gear teeth of said left and right clamps.

2. The spinning top, as recited in claim 1, wherein said conducting block has a protuberance extending therefrom and said sliding frame has recesses formed in correspondence to said protuberance.

3. The spinning, top as recited in claim 1, wherein said top has a cone-shaped shaft at a bottom portion thereof, said seat having a concave portion formed therein.

* * * * *